United States Patent [19]

Förster

[11] Patent Number: 5,054,546

[45] Date of Patent: Oct. 8, 1991

[54] VAPORIZER FOR GENERATING A MIXTURE OF SUPERHEATED STEAM AND FUEL VAPOR

[75] Inventor: Siegfried Förster, Alsdorf, Fed. Rep. of Germany

[73] Assignee: Forschungszentrum Jülich GmbH; Jülich, Fed. Rep. of Germany

[21] Appl. No.: 555,256

[22] Filed: Jul. 19, 1990

Related U.S. Application Data

[63] Continuation-in-part of Ser. No. 311,839, Feb. 16, 1989, Pat. No. 5,002,481, which is a continuation-in-part of Ser. No. 84,337, Aug. 15, 1987, abandoned.

[30] Foreign Application Priority Data

Jul. 20, 1989 [DE] Fed. Rep. of Germany ..... 3924012

[51] Int. Cl.[5] ..... F23D 11/44

[52] U.S. Cl. ..... 165/110; 165/139; 431/11; 431/12; 431/210; 431/211

[58] Field of Search ..... 431/11, 12, 211, 210, 431/212, 62, 89; 165/139, 110

[56] References Cited

. U.S. PATENT DOCUMENTS 411,712 9/1889 Clark ..... 431/211
746,409 12/1903 Turner ..... 431/212
1,097,066 5/1914 Turner ..... 431/212
1,719,397 7/1929 Edwards .
2,599,699 6/1952 Dilworth et al. ..... 431/89

FOREIGN PATENT DOCUMENTS 2636933 2/1988 Fed. Rep. of Germany .

*Primary Examiner*—Albert W. Davis, Jr.
*Attorney, Agent, or Firm*—Frishauf, Holtz, Goodman & Woodward

[57] ABSTRACT

Hot effluent gas from a burner or combustor passes over a pair of nested helical coils forming a steam generator 1 and a vapor mixing conduit 2. Liquid fuel is injected at 12 into a stream of superheated steam and vaporizes. The resulting mixture is combustible. In order to meter small amounts of fuel and water at constant pressure for fine adjustment of the fuel/water ratio in the vaporized mixture, a geared pump 15, 16 is provided in each of the water supply line 6 and the fuel supply line 7, feeding a respective injection tube or nozzle 11, 12. The injection tubes terminate respectively in the steam generator 1 and in the water vapor conduit 3, in a hot zone produced by the hot effluent gas. Preferably, magnetic valves 17, 18 are provided, downstream of each of pumps 15, 16, and are controlled as to frequency and opening time by a central control unit 19.

3 Claims, 2 Drawing Sheets

VAPORIZER FOR GENERATING A MIXTURE OF SUPERHEATED STEAM AND FUEL VAPOR

This application is a continuation of U.S. Ser. No. 07/ 311,839, filed Feb. 16, 1989 now U.S. Pat. No. 5,002,481, issued Mar. 26, 1991, which in turn is a continuation-in-part of U.S. Ser. No. 07/ 084,337, filed Aug. 10, 1987 and abandoned after allowance.

FIELD OF THE INVENTION

The present invention relates generally to a vaporizer for generating a combustible mixture of superheated steam and fuel vapor, and, more particularly, to an improved vaporizer which internally generates its steam and thereafter injects liquid fuel into a stream of the steam, to thereby vaporize the fuel.

BACKGROUND OF THE INVENTION

The present invention is an improvement upon the vaporizer disclosed in my earlier German Pat. No. DE-PS 36 26 933 C2 issued May 5, 1989, which corresponds to my aforementioned application U.S. Ser. No. 07/ 311,839. In that vaporizer, the fuel and water, for generating the vapor mixture, are fed continuously. When it is necessary to operate the combustor at a low thermal capacity, this continuous feeding leads to problems because then only small amounts of fuel and water are fed to the vaporizer, and these amounts are hard to properly ration or deliver. Further, when the mixture composition must be rapidly changed, one can only partially achieve proper matching of the components going into the mixture.

U.S. Pat. No. 1,719,397, EDWARDS, issued July 2, 1929, discloses drawing liquid fuel through a Venturi-type constriction f into a steam-carrying tube. However, one cannot generate a qualitatively constant fuel vapor/water vapor mixture in that manner.

THE INVENTION

Accordingly, it is an object of the present invention to permit feeding to the vaporizer of even small amounts of fuel and water with high precision, and to provide minimal-delay regulation of the amounts of fuel and water for matching of the fuel vapor/water vapor mixture to rapidly changing technical demands.

Briefly, this is achieved by pressurizing fuel and water supply lines using respective geared pumps, providing a microprocessor-controlled magnetically actuated valve in each supply line, terminating each supply line in an injection nozzle, and adjusting the valves in accordance with the currently desired fuel/steam ratio.

Placing the injection nozzles in a hot zone adjacent a central axis of the effluent gas channel facilitates fine dispersion of the water and fuel even when fed in small amounts. It also prevents undesirable pressure fluctuations in the resulting fuel vapor/water vapor mixture. The controllable metering or dosing system in each supply line provides the necessary pressure and quantity regulation.

The use of geared pumps provides high constant pressure in the water supply and fuel supply lines. The magnetically actuated valves permit quick adjustment of the respective amounts of fuel and steam in the mixture, to satisfy any technical requirements. Collectively, the gear pumps and magnetic valves form a metering system controlled by a central control unit. Preferably, the magnetic valves open at regular intervals actuated in the range of about 10–30 Hertz, and have opening times adjustable in a range between about 3 milliseconds and about 15 milliseconds.

DRAWINGS

DETAILED DESCRIPTION

Figure 1:
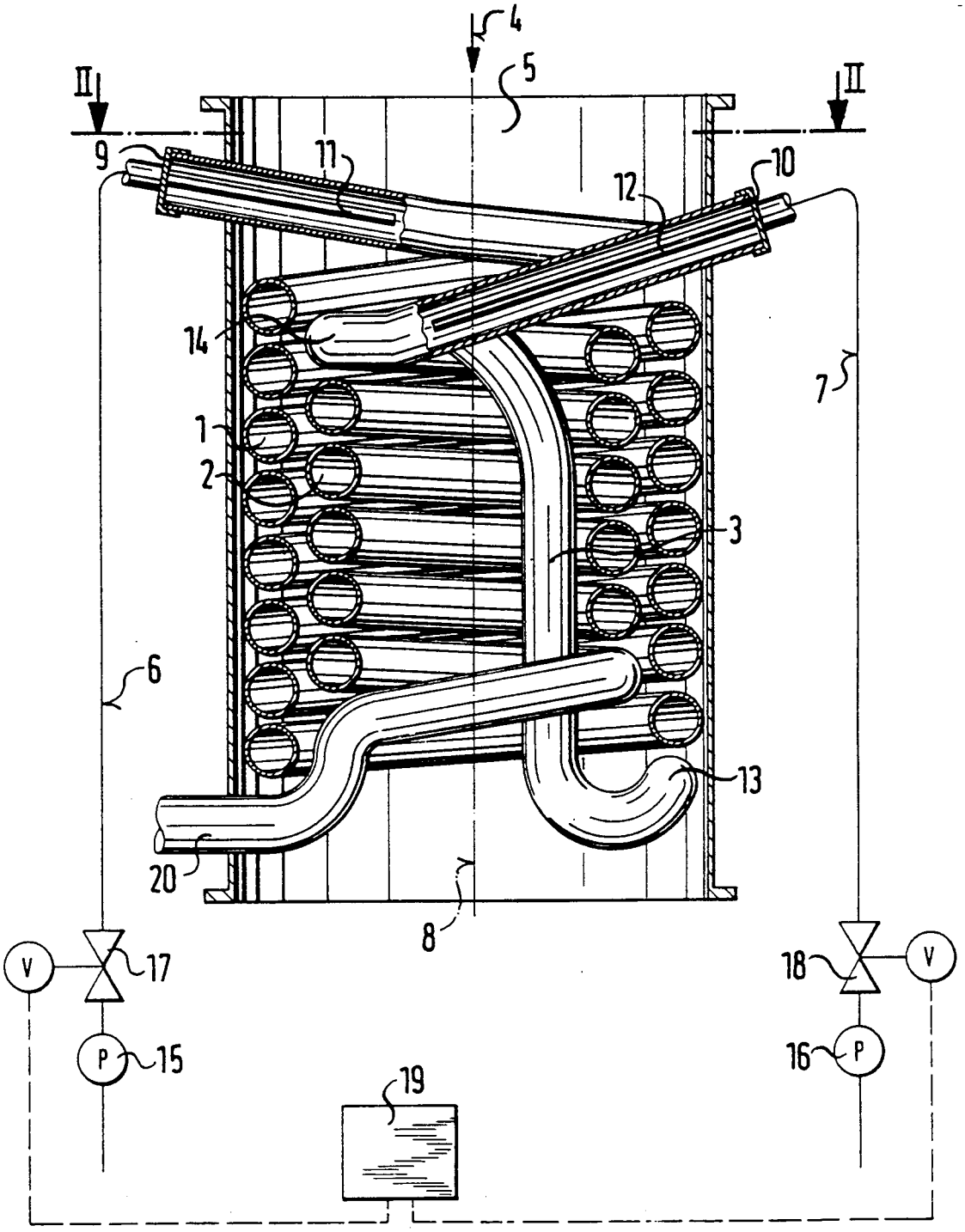
FIG. 1 is a vertical cross-section through the vaporizer of the present invention, taken along section line I—I of FIG. 2.

The drawings illustrate a vaporizer in which a water vapor generator 1, and a vapor mixing conduit 2, for generating a vapor mixture of superheated steam and vaporized fuel, are each formed as a helical tube. The vapor mixing conduit 2 is nested within the water vapor generator 1. A water vapor conduit 3 runs across the free interior space defined by the helical tubes, connects water vapor generator 1 to mixing conduit 2, and feeds the superheated steam generated in water vapor generator 1 to mixing conduit 2.

Both helical tubes 2 and 3 are preferably located in a combustion gas outlet channel 5 from a combustor. A flow of effluent combustion gas, schematically indicated by arrow 4, flows through channel 5 and serves to heat the steam generator 1 and the vapor mixing conduit 2. The steam formation and the formation of the fuel vapor/water vapor mixture occurs during downward flow of the media. At the respective upper ends of steam generator 1 and vapor mixing conduit 2, there are provided a water feeding conduit 6 and a liquid fuel feeding conduit 7.

Figure 2:
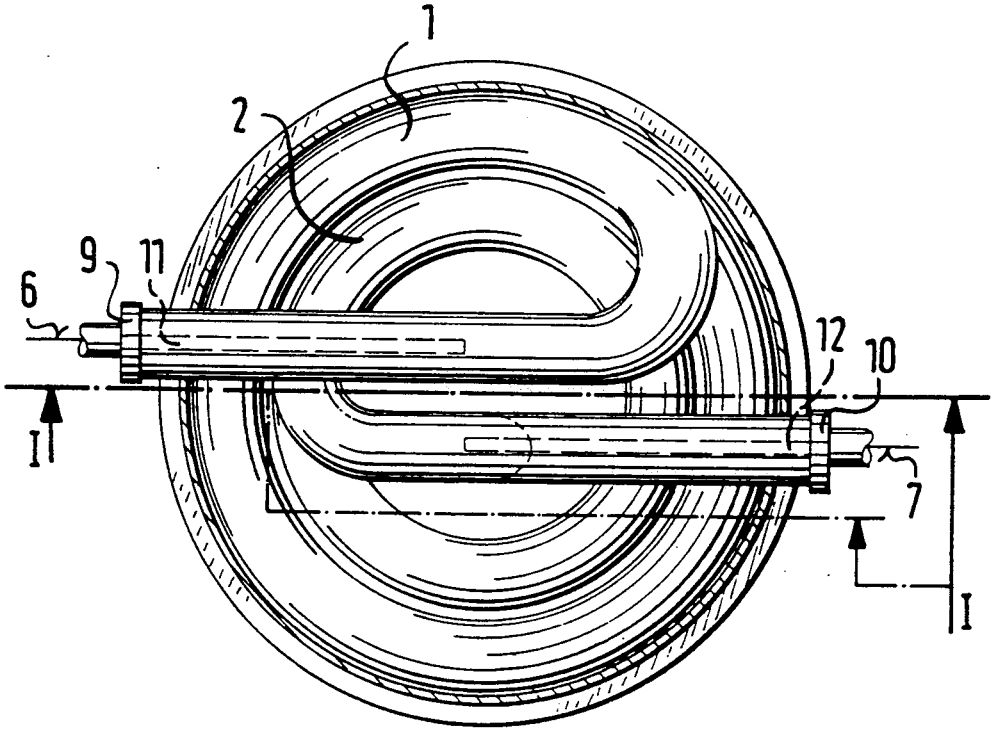
FIG. 2 is a partially cross-sectional view along line II—II of FIG. 1.

As shown most clearly in FIG. 2, conduit 6 terminates in a portion of tube 1 which runs approximately normal to the axis 8 (shown vertically) of the coils, and conduit 7 similarly terminates in a portion of tube 2 which runs approximately normal to coil axis 8.

A respective injection pipe 11, 12 is provided at the end of conduit 6 adjacent its junction 9 with steam generator 1 and at the end of fuel conduit 7 adjacent its junction 10. These pipes 11, 12 introduce the water and the fuel, respectively, into steam generator 1 and water vapor conduit 3. Pipes 11, 12 are respectively connected to conduits 6 and 7 so that they open into respective hot zones of steam generator 1 and water vapor conduit 3, i.e. in a portion near axis 8. This portion runs from an end 13 of steam generator 1 to a mouth 14 at the inlet of vapor mixing conduit 2.

Water conduit 6 and fuel conduit 7 are each connected at a pressure side to a respective geared pump 15, 16 which draws the water or fuel from a respective supply container (not shown). For regulation of the desired amounts of water and fuel, downstream of each pump 15, 16 is a respective electromagnetically actuated and clocked valve 17, 18. Valves 17, 18 are controlled by a central control unit 19 which may suitably be any commercially available microprocessor. Geared pumps 15, 16, magnetic valves 17, 18 and central control unit 19 together form a controllable dosing mechanism for matching the composition of the fuel vapor/-water vapor mixture to predetermined technical requirements.

MODE OF OPERATION.

Water passes out injection pipe 11 into steam generator 1, is vaporized by hot effluent gas 4 and superheated. At end 13 of steam generator 1, the superheated steam streams into conduit 3 and is directed to the mouth 14 of vapor mixing conduit 2. Here the superheated steam is directed over liquid fuel flowing out of injection pipe 12. The liquid fuel vaporizes in the superheated steam and forms, with the steam in conduit 2, the desired fuel vapor/water vapor mixture, which then flows out of the vaporizer through an outlet conduit 20.

In order to produce fuel vapor/water vapor mixtures with varying water and fuel content, it is possible to set the magnetic valves 17, 18 to clocking frequencies in a range of about 10–30 Hertz and to select opening times of anywhere from 3 milliseconds (ms) to 15 milliseconds. Pumps 15, 16 produce a pressure in water conduit 6 and fuel conduit 7 of about 20 bar (atmospheres). For optimal dispersion of the water and liquid fuel when feeding them into the steam generator 1 and into water vapor conduit 3, the preferred diameter of injection pipes 11, 12 is 1 millimeter (mm).

Various changes and modifications are possible within the scope of the inventive concept.

Preferably, the effluent gas 4 has a temperature in the range between 500° C. and 1500° C.

Preferably, the steam at point 14 has a temperature in the range between 350° C. and 450° C.

I claim:

1. Vaporizer for generating a combustible mixture of water vapor and superheated steam; comprising means (5) defining an outlet channel (5) for a flow (4) of combustion effluent gas;

a generally helical steam generator (1) located in said channel (5);

a generally helical mixing conduit (2) located in said channel (5);

a steam conduit (3) connecting one end of said steam generator (1) to said mixing conduit (2);

a water supply line (6) terminating in an injection nozzle (11) located in said steam generator;

a fuel supply line (7) terminating in an injection nozzle (12) located in said steam conduit (3); and means (15, 16; 17, 18; 19) for metering controlled amounts of water and fuel under pressure into said water supply and fuel supply lines (6,7), said means for metering including a geared pump (15, 16) and a magnetic valve (17, 18) in each of said water supply and fuel supply lines (6, 7).

2. Vaporizer according to claim 1, further comprising means (19) for adjusting an operating frequency of each of said magnetic valve and for setting a valve opening period.

3. Vaporizer according to claim 2, wherein said valve opening period is within a range between 3 milliseconds and 15 milliseconds.

* * * * *